US007997621B2

(12) United States Patent
Kauanoe

(10) Patent No.: US 7,997,621 B2
(45) Date of Patent: Aug. 16, 2011

(54) APPARATUS AND METHOD FOR MANEUVERING A SNOWBOARD

(76) Inventor: Robert Kauanoe, Kaaawa, HI (US)

( * ) Notice: Subject to any disclaimer, the term of this patent is extended or adjusted under 35 U.S.C. 154(b) by 383 days.

(21) Appl. No.: 12/291,937

(22) Filed: Nov. 14, 2008

(65) Prior Publication Data

US 2010/0078900 A1 Apr. 1, 2010

Related U.S. Application Data

(60) Provisional application No. 61/100,966, filed on Sep. 29, 2008.

(51) Int. Cl.
*A63C 11/00* (2006.01)

(52) U.S. Cl. ..... 280/814; 280/14.27; 280/637

(58) Field of Classification Search ..... 280/814, 280/14.27, 637
See application file for complete search history.

(56) References Cited

U.S. PATENT DOCUMENTS 5,894,684 A 4/1999 Sand et al.
5,904,056 A 5/1999 Ozaki
5,941,435 A 8/1999 Munro, III
5,951,048 A * 9/1999 Slaughter ..... 280/814
6,076,287 A 6/2000 Savard
6,267,390 B1 7/2001 Maravetz et al.
6,290,260 B1 9/2001 Brill
6,543,159 B1 4/2003 Carpenter et al.
6,634,657 B2 10/2003 Graham
6,923,455 B2 8/2005 Sullivan
7,137,925 B2 11/2006 Rozycki et al.

* cited by examiner

*Primary Examiner* — Jeffrey J Restifo
*Assistant Examiner* — Erez Gurari
(74) *Attorney, Agent, or Firm* — Diane E. Smith

(57) ABSTRACT

An apparatus and method for maneuvering a snowboard includes a removable strap that straps around a boot that attaches to a board. The removable strap includes an upper strap portion, a lower strap portion, and a securing strap portion. The securing strap portion is positioned under the boot and is attached to the lower strap portion. The lower strap portion is strapped to the boot and the upper strap portion is strapped above the lower strap portion. Attached to an outward facing section of the upper strap portion is a first handle which has a semi-rigid loop portion. By pulling the loop portion, an end section of the board may be maneuvered. Attached to an inward facing section of the lower strap portion is a second handle for assisting in stabilizing the board and used as leverage in pulling up into a standing position.

13 Claims, 4 Drawing Sheets

FIG.1
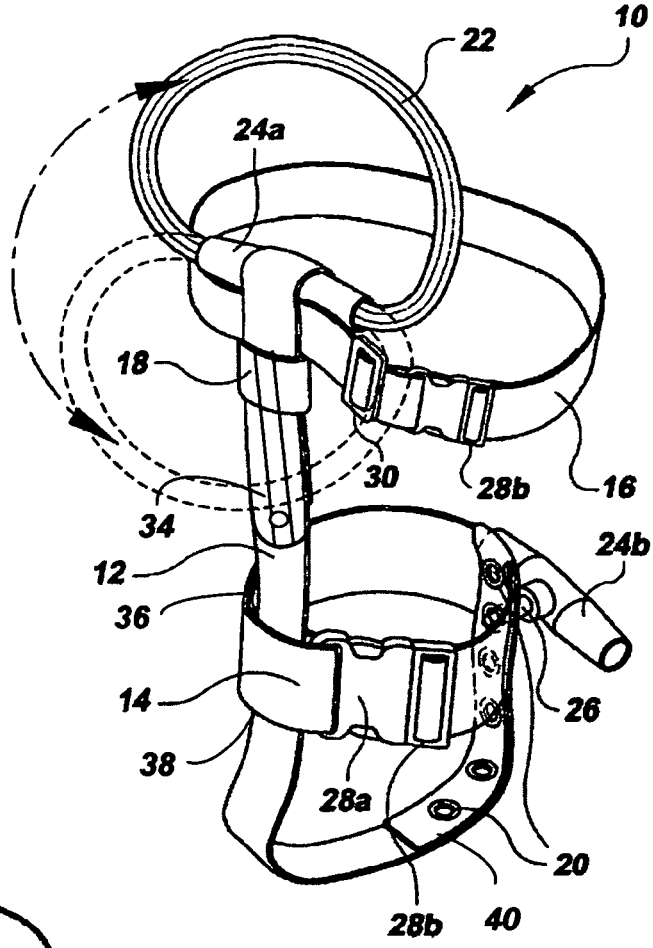
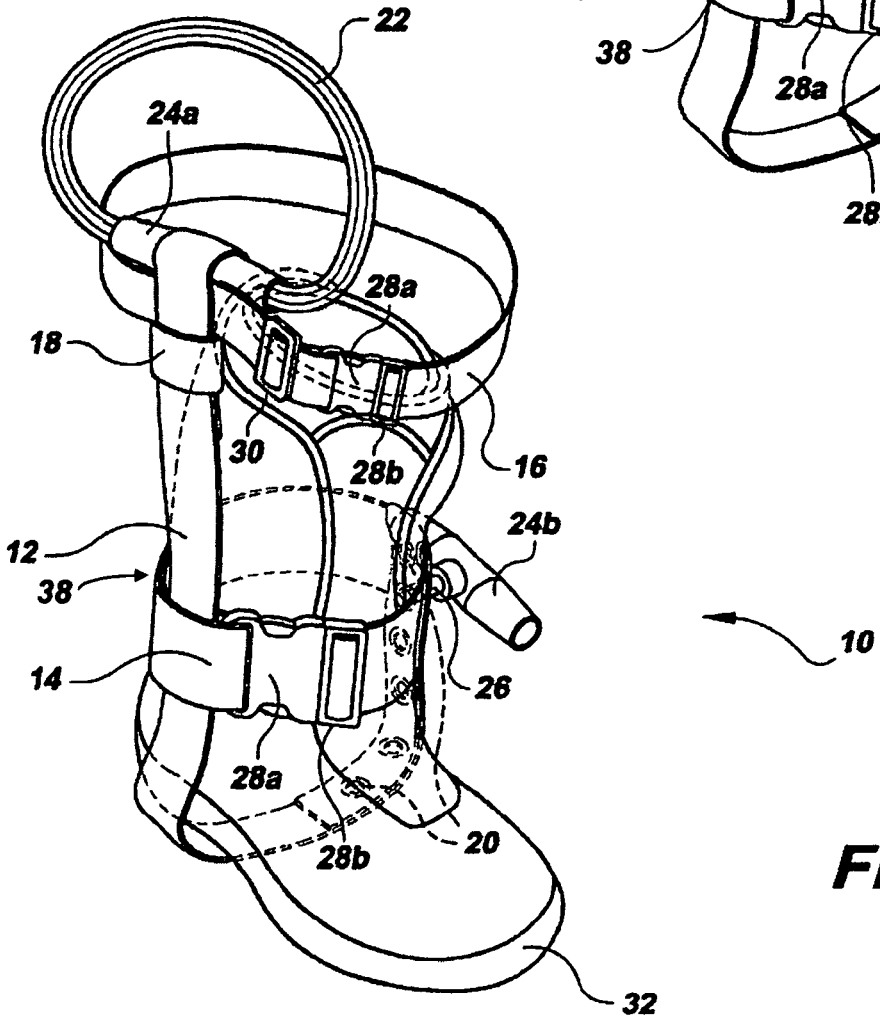
FIG.2

APPARATUS AND METHOD FOR MANEUVERING A SNOWBOARD

PRIORITY

This U.S. patent application claims priority to U.S. Provision Patent Application No. 61/100,966 filed on Sep. 29, 2008 and entitled A Handle Attached to Right and Left Snow Boots For Snow Boarding.

BACKGROUND

1. Field of the Invention

This disclosure relates to an apparatus and method for maneuvering a board having boots attached thereon, and more specifically relates to a removable strap having a loop handle for strapping around a snowboard boot to maneuver and stabilize a snowboard thereby.

2. Background Art

As the sport of snowboarding increases in popularity, methods and devices to aid in the balance and control of a snowboard also increases. Typically, a snowboard is controlled through shifts in weight or through the grasping of the snowboard. A snowboarder learns several methods to maneuver their board, such as turning the board, standing up from a fallen position or flipping over. For a beginner, balancing and controlling a snowboard takes time and practice, especially after falling and attempting to get up again. Even a more advanced snowboarder may find it hard to maneuver the board in certain situations, especially when tired.

In prior art, one way to control a snowboard is through an addition of handles to the snowboard. Adding handles to the snowboard provides a way to balance and steer the snowboard. One main handle on a snowboard may be used to convert a snowboard into a snow scooter. One or two handles attached to the snowboard that can be easily grabbed while standing may also be used by beginners in improving their balance. These handles may be permanent or detachable on a snowboard, but either way, they require a specialized snowboard that can accommodate the handles. Unfortunately, extra expense is required for acquiring a specialized snowboard that may not be used all the time. Also, a more advanced snowboarder would be limited in their manuevers and could sustain injuries on handles protruding too far out of the snowboard or made of too rigid of a material.

Thus, there is a need to provide flexibility in movement and control in snowboarding with an apparatus that may be used with most types of snowboards and by any level of snowboarder.

SUMMARY

An apparatus and method for maneuvering a snowboard includes a removable strap that straps around a boot that attaches to a board. The removable strap includes an upper strap portion, a lower strap portion, and a securing strap portion. The securing strap portion is positioned under the boot and is attached to the lower strap portion. The lower strap portion is strapped to the boot and the upper strap portion is strapped above the lower strap portion. Attached to an outward facing section of the upper strap portion is a first handle which has a semi-rigid loop portion. By pulling the loop portion, an end section of the board may be maneuvered. Attached to an inward facing section of the lower strap portion is a second handle for assisting in stabilizing the board and used as leverage in pulling up into a standing position.

With removable straps strapped around both boots, both end sections of the snowboard may be controlled at the same time through the handles. Thus, by pulling on the loop portions from both removable straps simultaneously, the snowboard is maneuvered closer to the snowboarder.

The foregoing and other features will be apparent from the following more particular description, as illustrated in the accompanying drawings.

BRIEF DESCRIPTION OF THE DRAWINGS

The disclosure will be described in conjunction with the appended drawings, where like designations denote like elements, and:

FIG. 1 is a perspective view of a removable strap with handles;

FIG. 2 is a perspective view of the removable strap with handles of FIG. 1 strapped to a boot;

DETAILED DESCRIPTION

Figure 4:
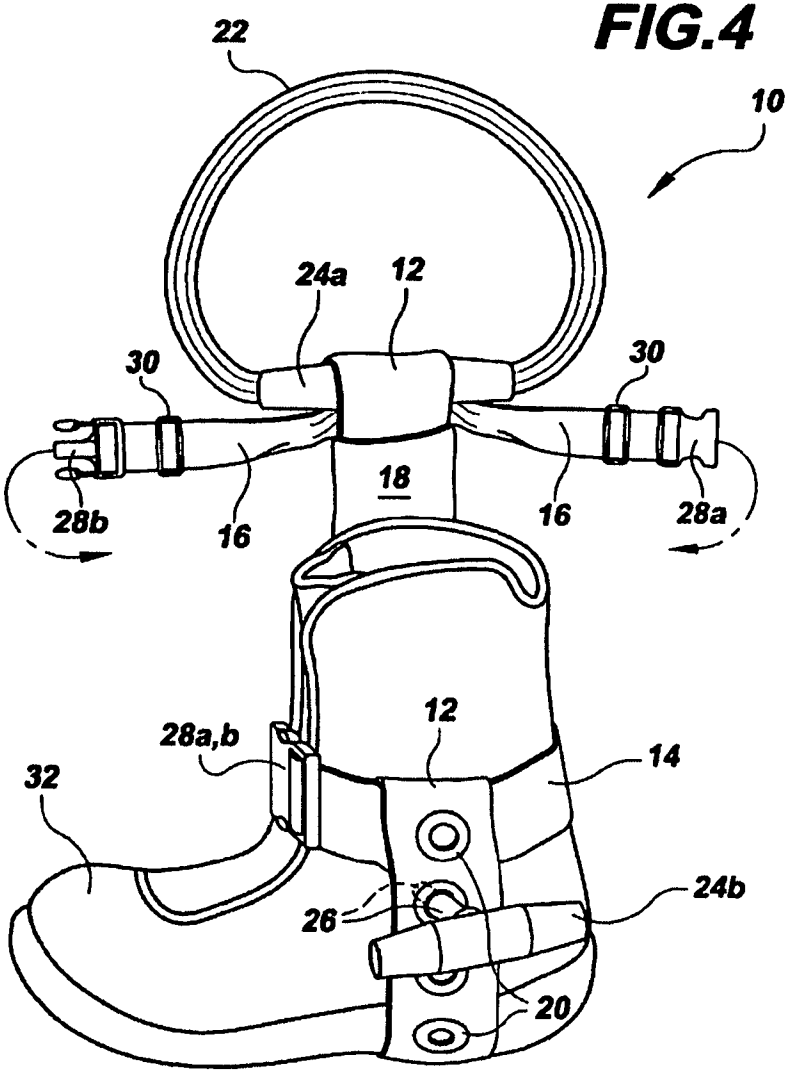
FIG. 4 is a side elevation view of the removable strap with handles of FIG. 1 strapped to a boot from the inward facing side of the boot.

Referring now to FIG. 1, a removable strap with handles 10 includes an upper strap portion 16; a lower strap portion 14; a securing strap portion 12; a first handle having a loop portion 22, an upper support portion 24*a*, and an upper securing strap 18; and a second handle 24*b*. In this specific example, upper strap portion 16 includes attachment clips 28*a* and 28*b*, and strap length adjustable fastening mechanism 30, such as a fastening clip, velcro attachment, or buckle. Attachment clips include a female portion 28*a* and a male portion 28*b*. Like upper strap portion 16, lower strap portion 14 includes attachment clips with a female portion 28*a* and a male portion 28*b* and an adjustable fastening mechanism 36. Lower strap portion 14 also includes a slot 38, which is formed through adjustable fastening mechanism 36. Examples for materials for upper strap portion 16 and lower strap portion 14 may include a 1 inch nylon strap, and a 2 inch nylon strap, respectively, but the disclosure is not limited to such. Also, an example of adjustable fastening mechanism 36 may include velcro attachments. It is to be understood, though, that other attachments or adjustable mechanisms that are well known in the art may also be used in both the upper strap portion 16 and the lower strap portion 14 and the disclosure is not limited by such.

Securing strap portion 12 attaches to upper strap portion 16 with an adjustable fastener 34, such as a velcro fastener or a sliding adjustable mechanism, and through an upper securing strap 18. Examples for adjustable fastener 34 and upper securing strap 18 may include velcro fasteners, clips, sliding adjustable mechanisms or similar fasteners that are well-known in the art. Also, an example of the material for securing strap portion 12 may include a 2 inch nylon strap, but the disclosure is not limited to such. Securing strap portion 12 attaches to lower strap portion 14 through an adjustable fastener 40, such as a velcro fastener, after threading through slot 38 of lower strap portion 14. Securing strap portion 12 may be adjusted through adjustable fastener 34 and adjustable fastener 40. As with strap length adjustable fastening mechanism 30 and adjustable fastening mechanism 36, adjustable fastener 34 and 40 may be provided so that the most desirable fit for removable strap with handles 10 can be selected. Although in this example removable strap with handles 10 is adjustable by adjustable fasteners 34 and 40 and adjustable fastening mechanisms 30 and 36, it is to be understood that the disclosure is not to be limited by such, and removable strap with handles 10 may also be non-adjustable or adjustable by other means that are well known in the art.

Loop portion 22 is attached to an outward facing section of upper strap portion 16 through upper support portion 24*a* and adjustable fastener 34. Loop portion 22 consists of a flexible, but semi-rigid material, such as nylon cord, each end of the cord joined together by the upper support portion 24*a*, forming a loop handle. Loop portion 22 may also have a protective coating such as a clear nylon or polyester about its outside perimeter for further protection from the environment. Upper securing strap 18 further secures upper support portion 24*a*, keeping upper support portion 24*a* in an upright "t" position. Loop portion 22 may be raised or lowered in reference to lower strap portion 14 through adjustable fastener 34. Loop portion 22 is of a diameter that is large enough to be easily grabbed by a hand or a glove (approximately between 3-6 inches diameter), but small enough not to be easily snagged by protrusions. Loop portion 22 is also rigid enough to stay upright against the outside of a leg of a user, but flexible enough not to injure the user if they happen to fall on it. Upper support portion 24*a* may be tee-shaped, or crescent-shaped to aid in the formation of the loop handle. Also, upper support portion 24*a* may comprise of a plastic, or similar non-corrosive material.

Second handle 24*b* is attached to an inward facing section of lower strap portion 14 through holes 20, such as grommet holes, and attachment mechanism 26, such as a pin and clip assembly. Grommet holes may be of an inner diameter of ½ inch. Although specific grommet holes and a pin and clip assembly is specified for this example, other fastening mechanisms that are well-known in the art may also be used to attach second handle 24*b* to lower strap portion 14. Some examples for second handle 24*b* may include a tee-shaped handle, or a U-shaped handle, but any handle that is suitable for grasping may be used and the disclosure is not limited to such. Second handle 24*b* provides stability to a user when pulled and may be used as leverage in pulling up into a standing position (as will be discussed in more detail in reference to FIG. 5).

FIG. 2 illustrates the removable strap with handles 10 of FIG. 1 when strapped to a boot 32, such as a snowboard boot. One feature of the disclosure is any board or boot attachable to the board may be used with the removable strap without changing or adding permanent attachments to the board, boot, or bindings for the boot. Furthermore, there is only a small amount pressure on the existing binding when removable strap with handles 10 is pulled. As seen in FIG. 2, the end of securing strap 12 that is attached to lower strap portion 14 is positioned under boot 32 and is adjustable to fit the bottom of the boot 32 through slot 38. Lower strap portion 14 straps around boot 32 and is adjustable through adjustable fastening mechanism 36 to fit firmly on boot 32. Upper strap portion 16 either straps around boot 32 or onto the leg of the user (not shown) and is adjustable through strap length adjustable fastening mechanism 30.

Figure 3:
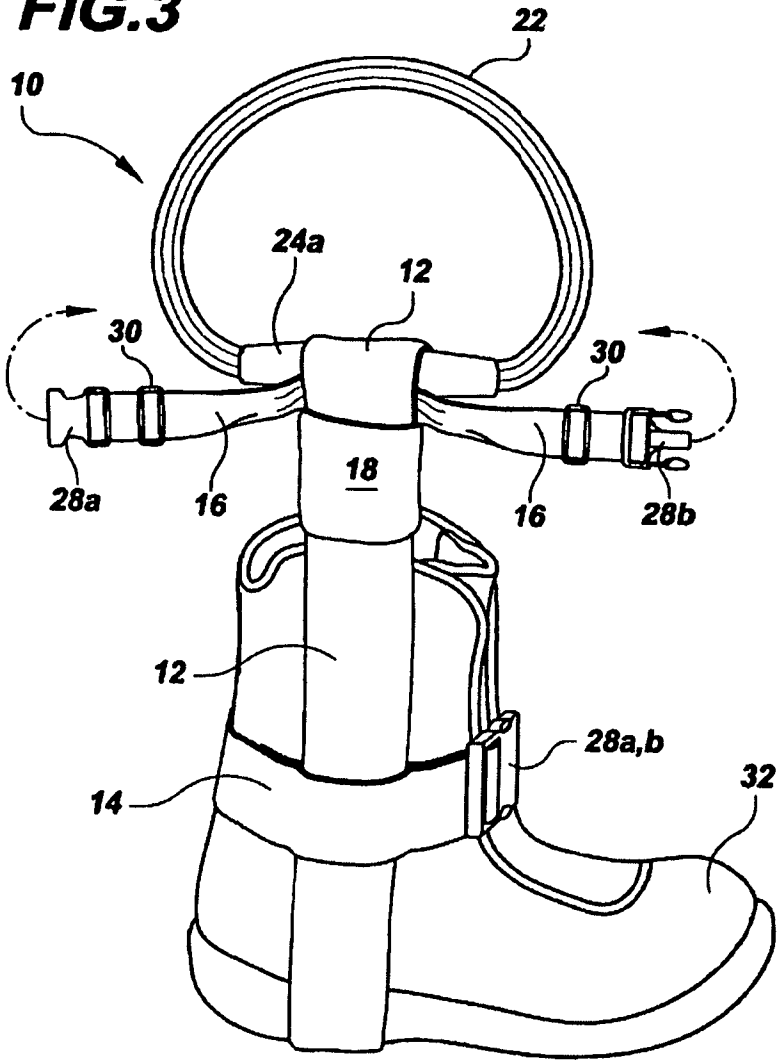
FIG. 3 is a side elevation view of the removable strap with handles of FIG. 1 strapped to a boot from the outward facing side of the boot.

FIG. 3 is the side view of the outward facing side of boot 32. As seen in FIG. 3, loop portion 22 is adjustable and attached to the outward facing section of upper strap portion 16 so that loop portion 22 may be reachable by the user on the outward facing side of boot 32.

FIG. 4 is the side view of the inward facing side of boot 32. Second handle 24*b* is adjustable and attached to the inward facing section of lower strap portion 14 so that second handle 24*b* may be accessible by the user on the inward facing side of boot 32. Although second handle 24*b* may be used for both a right and left boot, it is also to be understood that second handle 24*b* may only be used for one boot and taken off the removable strap with handles 10 for the second boot.

Figure 5:
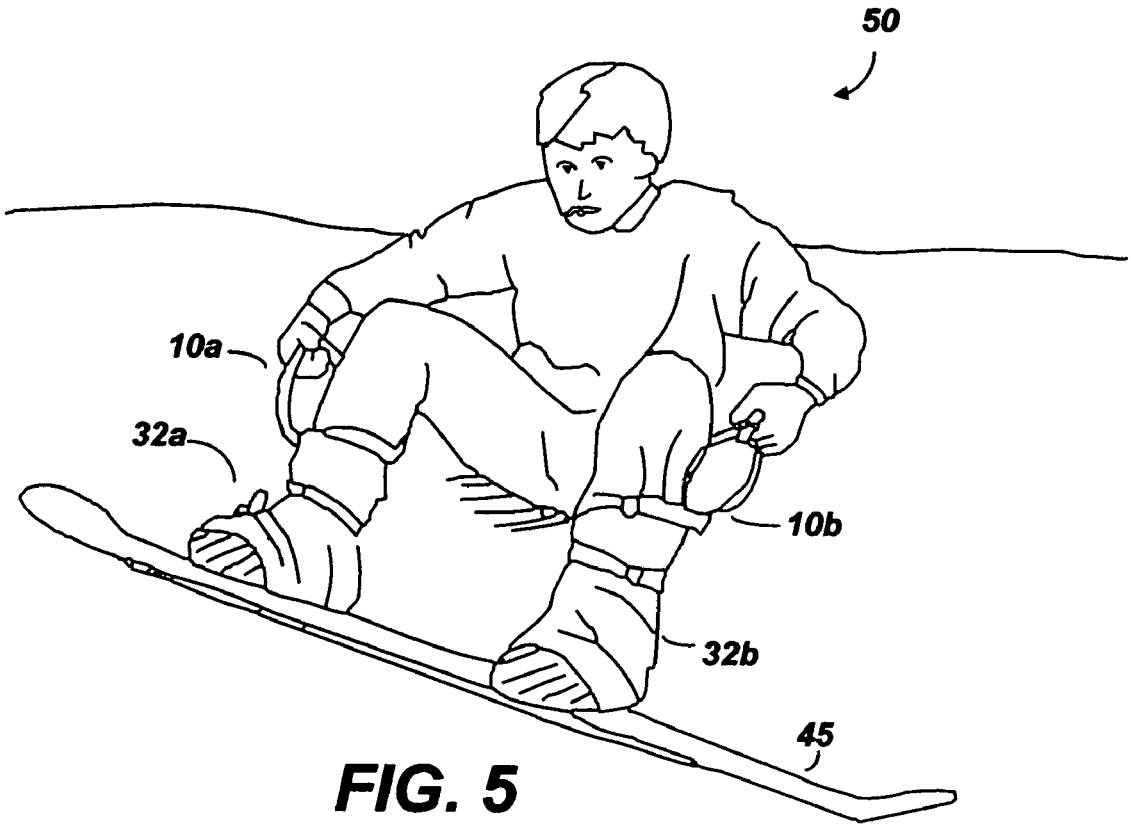
FIGS. 5, 6, 7 and 8 illustrate various positions of a user with a pair of the removable strap with handles of FIG. 1.

FIGS. 5, 6, 7 and 8 illustrate examples of some maneuvers that may be implemented on a snowboard using removable strap with handles 10. Specifically, FIG. 5 illustrates a user 50 pulling removable straps with handles 10*a* and 10*b* strapped on boots 32*a* and 32*b*, respectively. Since both handles are essentially being pulled at the same time, both ends of board 45 are brought closer to user 50, thus the whole board 45 is brought closer to user 50. This allows user 50 some leverage in standing up or in performing jumps, which may be used if user 50 is inexperienced, tired, or trying out new maneuvers.

Figure 6:
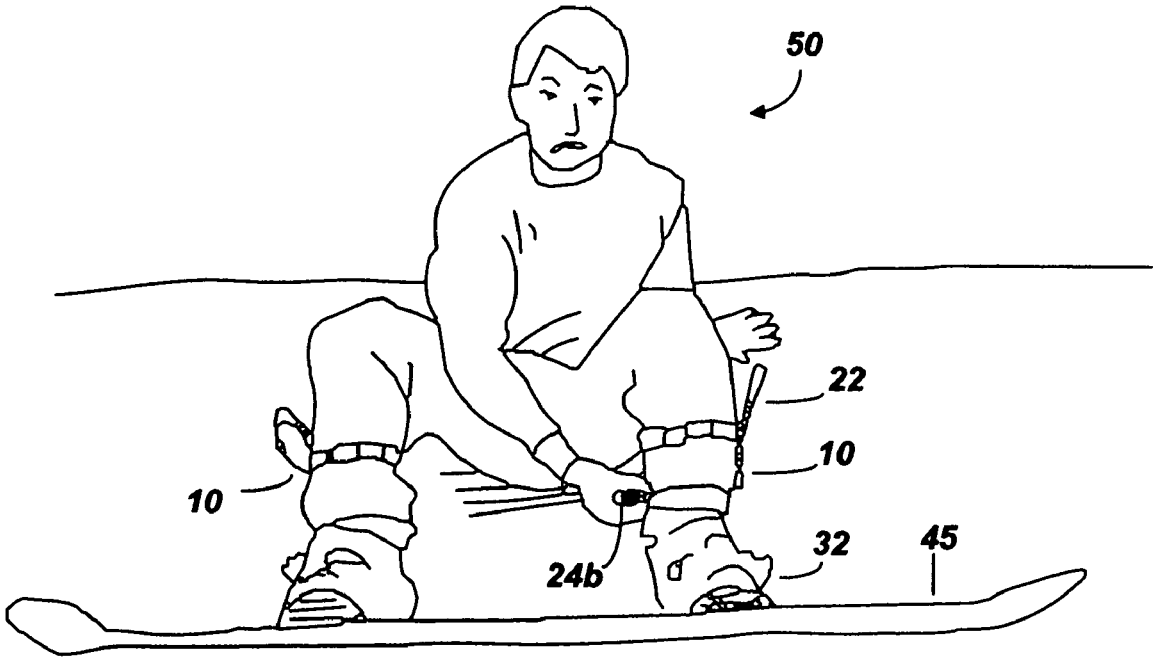

FIG. 6 illustrates user 50 grasping second handle 24*b* with the hand opposite of the second handle. By pulling second handle 24*b* and leveraging the arm against the leg, user 50 may stand up or slowly sit down without having to grasp the board 45. As previously disclosed, both boots may have removable strap with handles 10 with second handle 24*b*, or, if only one second handle 24*b* is used by user 50, then second handle 24*b* may be removed from the removable strap with handles 10 for the other boot.

Figure 7:
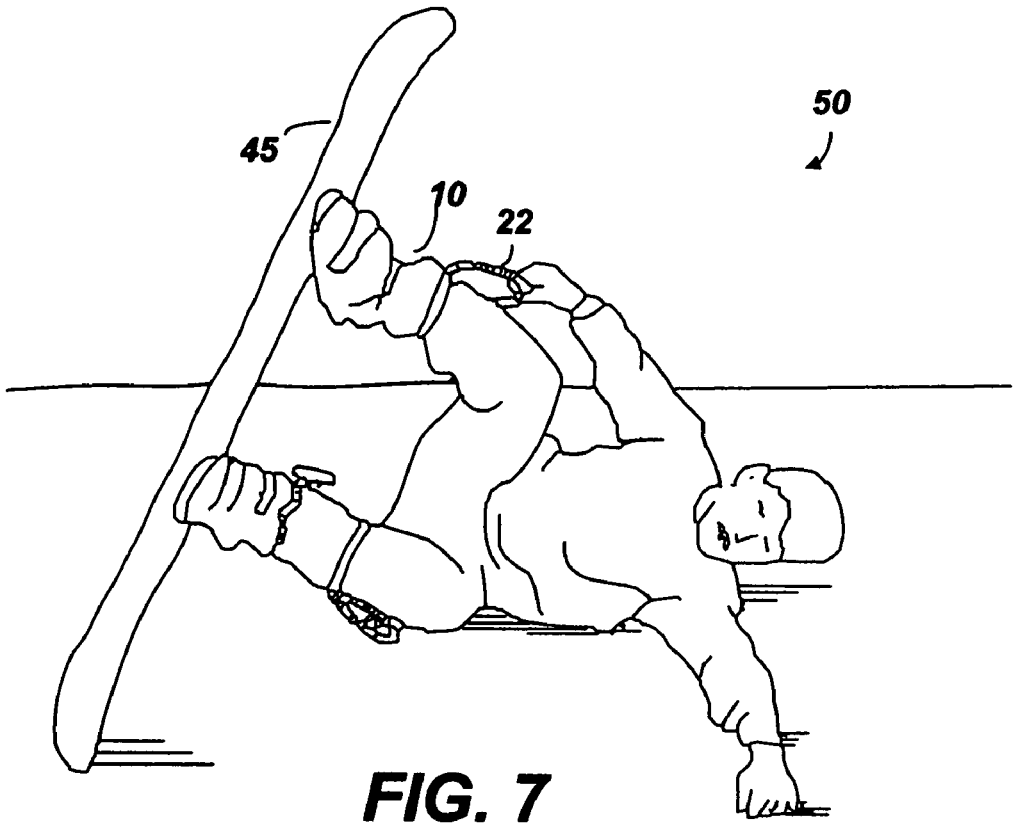

FIG. 7 illustrates user 50 maneuvering one end of board 45 by pulling the loop portion 22 closest to that end of board 45. This maneuver may be used when user 50 is on their side or back and wants to flip over on their knees without putting excessive strain on their knees while they flip. Pulling a single loop portion 22 may also be used in various aerial maneuvers, such as flips, rolls and spins. In fact, some maneuvers may be only performed with removable strap with handles 10 (which also could be known as the Snow Grabba, but is not limited to such), such as the Ronnie Roll, which is a mid-air stall with a roll; the Shalom Spin, which is grasping the opposite loop portion 22 and spinning the board 45 in the air; and the Rolling Rob, which is similar to a plane's victory roll.

Figure 8:
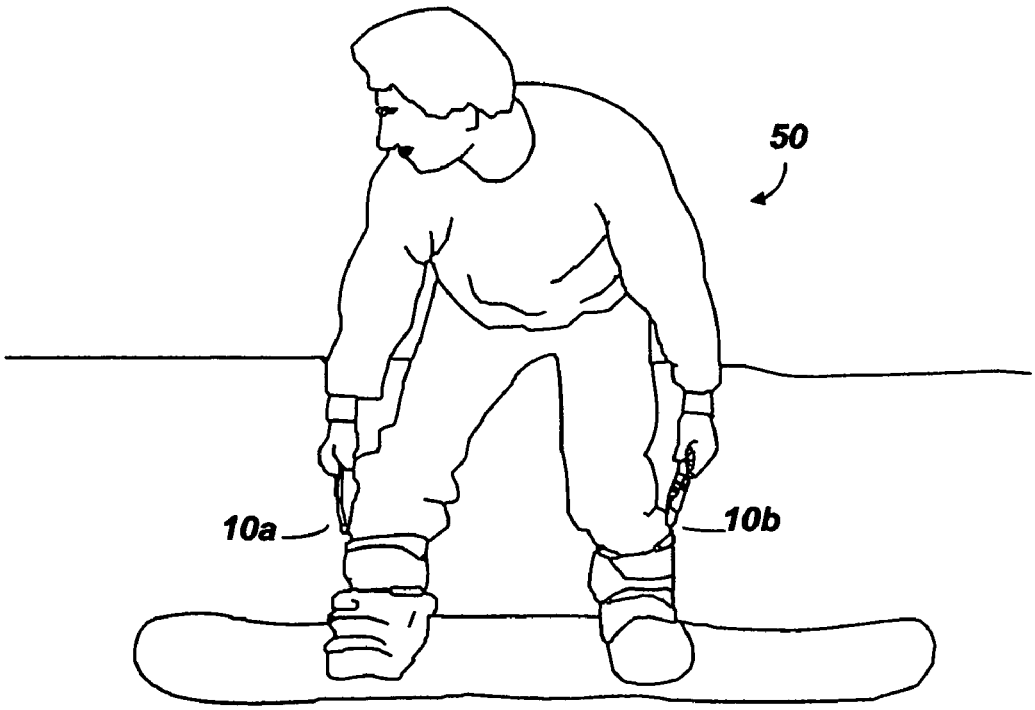

FIG. 8 illustrates user 50 grasping both removable straps with handles 10*a* and 10*b* to achieve balance. This feature of the disclosure may be used by those who are beginners, any user that has trouble balancing, or those desiring to try new maneuvers.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims. For example, although snowboarding and snowboard boots are specifically disclosed to be used in the present disclosure, it is to be understood that any type of boot or shoe that attaches to a board may also be used, such as with sand surfing, and the disclosure is not limited to such. Therefore, reference herein to snowboarding is only by way of example, and is not intended to be limiting.

The invention claimed is:

1. An apparatus comprising:

a boot;

a removable strap for strapping around the boot, the boot attachable to a board having an end section, the strap having an upper strap portion, a lower strap portion, and a securing strap portion attached to the upper strap portion and to the lower strap portion, wherein a section of the securing strap portion straps around a bottom of the boot;

a first handle having a loop portion attached to an outward facing section of the upper strap portion;

and a second handle attached to an inward facing section of the lower strap portion, wherein the loop portion of the first handle maneuvers the end section of the board and the second handle stabilizes the board.

2. The apparatus of claim 1, wherein the loop portion comprises a semi-rigid cord.

3. The apparatus of claim 1, wherein the removable strap is a first removable strap for strapping around a first boot, the apparatus further comprising: a second removable strap for strapping around a second boot, the second strap having an upper strap portion and a lower strap portion; a first handle of the second strap having a loop portion attached to an outward facing section of the upper strap portion of the second strap; and a second handle of the second strap attached to an inward facing section of the lower strap portion of the second strap.

4. The apparatus of claim 1, wherein the boot is a snowboot and the board is a snowboard.

5. The apparatus of claim 1, wherein the lower strap portion and the securing strap portion are adjustable with respect to the boot.

6. The apparatus of claim 3, wherein the first handle of the first strap maneuvers the end section of the board and the first handle of the second strap maneuvers an opposite end section of the board.

7. The apparatus of claim 1, wherein the first handle further comprises: an upper support portion; a cord having a first end and a second end, the first end attaching to the second end through the upper support portion, forming the loop portion; and an upper securing strap that secures the support portion to the securing strap portion.

8. An apparatus comprising: a snowboard having a first end section and a second end section; a first boot and a second boot attachable to the snowboard; a removable strap for strapping around the first boot, the strap having an upper strap portion, a lower strap portion and a securing strap portion attached to the upper strap portion and to the lower strap portion, wherein a section of the securing strap portion straps around a bottom of the first boot; a first handle having a loop portion attached to an outward facing section of the upper strap portion; and a second handle attached to an inward facing section of the lower strap portion, wherein the loop portion of the first handle maneuvers the first end section of the snowboard and the second handle stabilizes the snowboard.

9. The apparatus of claim 8, wherein the loop portion comprises a semi-rigid cord.

10. The apparatus of claim 8, wherein the removable strap is a first removable strap for strapping around the first boot, the apparatus further comprising: a second removable strap for strapping around the second boot, the second strap having an upper strap portion and a lower strap portion; a first handle of the second strap having a loop portion attached to an outward facing section of the upper strap portion of the second strap; and a second handle of the second strap attached to an inward facing section of the lower strap portion of the second strap.

11. The apparatus of claim 8, wherein the lower strap portion and the securing strap portion are adjustable, with respect to the first boot.

12. The apparatus of claim 10, wherein the first handle of the first strap maneuvers the first end section of the snowboard and the first handle of the second strap maneuvers the second end section of the snowboard.

13. The apparatus of claim 8, wherein the first handle further comprises: an upper support portion; a cord having a first end and a second end, the first end attaching to the second end through the upper support portion, forming the loop portion; and an upper securing strap that secures the support portion to the securing strap portion.

* * * * *